US006417808B1

(12) United States Patent
Ide

(10) Patent No.: US 6,417,808 B1
(45) Date of Patent: Jul. 9, 2002

(54) TRANSCEIVER INCLUDING ANTENNA APPARATUS WHICH IS COMPACTLY ACCOMMODATED IN BODY OF TRANSCEIVER

(75) Inventor: Yoshiyuki Ide, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/520,906

(22) Filed: Mar. 7, 2000

(51) Int. Cl.[7] ..... H01Q 1/36
(52) U.S. Cl. ..... 343/702; 343/895; 343/900
(58) Field of Search ..... 343/895, 725, 343/729, 702, 900; 455/90

(56) References Cited

U.S. PATENT DOCUMENTS

| | | | | |
|---|---|---|---|---|
| 5,504,494 A | * | 4/1996 | Chatzipetros et al. | 343/702 |
| 5,764,191 A | * | 6/1998 | Tsuda | 343/702 |
| 5,861,859 A | * | 1/1999 | Kanayama et al. | 343/895 |
| 6,037,906 A | * | 3/2000 | Engblom | 343/702 |

FOREIGN PATENT DOCUMENTS

| | | |
|---|---|---|
| EP | 0755091 | 1/1997 |
| EP | 0805506 | 5/1997 |
| EP | 0833402 | 4/1998 |
| JP | 7122917 | 5/1995 |
| JP | 7131220 | 5/1995 |
| JP | 7336122 | 12/1995 |
| JP | 884017 | 3/1996 |
| JP | 2503856 | 4/1996 |
| WO | 96/24962 | 8/1996 |
| WO | 97/02662 | 2/1997 |
| WO | 97/49141 | 12/1997 |
| WO | 98/15029 | 4/1998 |
| WO | 98/28856 | 7/1998 |
| WO | 99/26314 | 5/1999 |
| WO | 99/39403 | 8/1999 |

* cited by examiner

*Primary Examiner*—Don Wong
*Assistant Examiner*—James Clinger
(74) *Attorney, Agent, or Firm*—Dickstein, Shapiro, Morin & Oshinsky, LLP.

(57) ABSTRACT

A transceiver includes a body, a first antenna fixed to the body, a bar antenna, an insulating section coupled to the bar antenna and a second antenna coupled to the insulating section. The bar antenna can be accommodated in the body. The first and second antennas are electrically connected to form a third antenna when the bar antenna is accommodated in the body.

20 Claims, 18 Drawing Sheets

TRANSCEIVER INCLUDING ANTENNA APPARATUS WHICH IS COMPACTLY ACCOMMODATED IN BODY OF TRANSCEIVER

BACKGROUND OF THE INVENTION

1. Field of the Invention

The present invention relates to a transceiver. More particularly, the present invention relates to a transceiver including an antenna apparatus which can be compactly accommodated in a body of the transceiver.

2. Description of the Related Art

A bar whip antenna is used in a portable transceiver. At a time of transmission or reception, the whip antenna is pulled out from a body of the portable transceiver. At a time of wait, the whip antenna is accommodated in the body of the portable transceiver. Electromagnetic waves are received by the whip antenna and processed by a signal processing circuit in the portable transceiver. Also, electromagnetic waves generated by the signal processing circuit are transmitted through the whip antenna.

It is necessary that an impedance of the antenna apparatus of the portable transceiver and an impedance of the signal processing circuit match with each other. Therefore, an impedance matching circuit is used for converting the impedance of the signal processing circuit. However, the impedance of the bar whip antenna when it is accommodated is different from that when it is pulled out. For this reason, if the impedance of the whip antenna is matched with the impedance of the impedance matching circuit with each other in the condition that the whip antenna is pulled out from the body, it is impossible to match the impedance of the whip antenna and the impedance of the impedance matching circuit with each other in the condition that the whip antenna is accommodated.

For this reason, an antenna apparatus is used in which a helical antenna is mounted at an end of a straight (bar) antenna. A portable transceiver containing such an antenna apparatus is disclosed in Japanese Laid Open Patent Application (JP-A-Heisei 8-84017). The conventional portable transceiver includes a body 101 and a bar antenna 102 as shown in FIGS. 1 and 2. An end of the bar antenna 102 is inserted into the body 101. The bar antenna 102 includes a bar conductor 103, as shown in FIG. 3. The bar conductor 103 is covered with a dielectric sleeve 104. A conductive terminal 105 is connected to an end inserted into the body 101. The conductive terminal 105 is coupled to the conductor 103.

A dielectric 106 is coupled to the other end of the bar antenna 102, as shown in FIGS. 1 and 2. An conductive connector 107 is coupled to the dielectric 106. A helical antenna 108 is coupled to the conductive connector 107. The helical antenna 108 is covered with a cover 109.

On the other hand, a slide terminal 110 is coupled to the body 101. The slide terminal 110 is slid and connected to the bar antenna 102. The slide terminal 110 is connected to the impedance matching circuit 111. The impedance matching circuit 111 is connected to the signal processing circuit 112. The impedance matching circuit 111 matches the impedance of the bar antenna 102 and the helical antenna 108 with that of the signal processing circuit 112. The signal processing circuit 112 processes electromagnetic waves received by the bar antenna 102 or the helical antenna 108. Moreover, the signal processing circuit 112 generates electromagnetic waves, and transmits the electromagnetic waves through the bar antenna 102 or the helical antenna 108.

The bar antenna 102 is used in an extended state in a case of long distance communication, as shown in FIG. 1. In the condition when the bar antenna 102 is extended, the conductive terminal 105 is connected to the slide terminal 110. The bar antenna 102 transmits or receives the electric wave. The bar antenna 102 is used in the accommodated state in a case of short distance communication, as shown in FIG. 2. In the condition that the bar antenna 102 is accommodated, the conductive connector 107 is connected to the slide terminal 110. The helical antenna 108 transmits or receives electromagnetic waves. The conventional portable transceiver receives electromagnetic waves the impedance being matched, in any case of the accommodated antenna and the extended antenna.

In order to increase a gain, it is necessary that an effective height of the helical antenna 108 is equal to or greater than one fourth of a wave length of electromagnetic waves received by the helical antenna 108. Thus, a number of loops of the helical antenna 108 are required such that the effective height becomes equal to or greater than about one fourth of the wave length of the electromagnetic waves. The helical antenna 108 is needed to have a considerable size in accordance with the number of the loops.

Other portable transceivers are disclosed in Japanese Laid Open Patent Application (JP-A-Heisei 7-131220, JP-A-Heisei 7-122917 and JP-A-Heisei 7-336122) and Japanese Patent Gazette (JP-B-2503856).

A portable transceiver is desirable in which an antenna is compact and a gain characteristic of the antenna is excellent when it is accommodated in a body.

SUMMARY OF THE INVENTION

Therefore, an object of the present invention is to provide a portable transceiver in which an antenna is compact and a gain characteristic of the antenna is excellent when it is accommodated in a body.

In order to achieve an aspect of the present invention, a transceiver includes a body, a first antenna fixed to the body, a bar antenna, an insulating section coupled to the bar antenna and a second antenna coupled to the insulating section. The bar antenna can be accommodated in the body. The first and second antennas are electrically connected to form a third antenna when the bar antenna is accommodated in the body.

Desirably, the third antenna has an effective height larger than one fourth of a wave length of a electromagnetic wave receive d by the third antenna.

The bar antenna may be. electrically connected to the first antenna to form a fourth antenna when the bar antenna is pulled out of the body. In this case, the third and fourth antennas have substantially same impedance.

The bar antenna and the second antenna may have substantially same impedance.

Desirably, the fourth antenna have an effective height larger than one fourth of a wave length of electromagnetic waves received by the fourth antenna.

The first and second antennas may be capacitively connected to form the third antenna when the bar antenna is accommodated in the body In this case, the second antenna may include a conductive portion. And the first antenna and the conductive portion may form a capacitance when the bar antenna is accommodated in the body.

The first antenna and the bar antenna may be capacitively connected to form a fourth antenna when the bar antenna is pulled out of the body.

In this case, the bar antenna may include a second conductive portion. And the first antenna and the second conductive portion may form a capacitance when the bar antenna is pulled out of the body.

The transceiver may further include a first conductive terminal coupled to the first antenna and a second conductive terminal coupled to the second antenna. In this case, the first conductive terminal has a first contacting surface. The second conductive terminal has a second contacting surface. The first conductive terminal contacts the second conductive terminal on the first and second contacting surfaces when the bar antenna is accommodated in the body.

The transceiver may further include a third conductive terminal coupled to the first antenna and a fourth conductive terminal coupled to the bar antenna. The third conductive terminal has a third contacting surface. The fourth conductive terminal has a fourth contacting surface. The third conductive terminal contacts the fourth conductive terminal on the third and fourth contacting surfaces when the bar antenna is pulled out of the body The first antenna may include a helical antenna.

The second antenna may include a second helical antenna.

In order to achieve another aspect of the present invention, a radio receiver includes a body, a first antenna fixed to the body, a bar antenna, an insulating section coupled to the bar antenna and a second antenna coupled to the insulating section. The bar antenna can be accommodated in the body. The first and second antennas are electrically connected to form a third antenna when the bar antenna is accommodated in the body.

In order to achieve still another aspect of the present invention, a radio transmitter includes a body, a first antenna fixed to the body, a bar antenna, an insulating section coupled to the bar antenna and a second antenna coupled to the insulating section. The bar antenna can be accommodated in the body. The first and second antennas are electrically connected to form a third antenna when the bar antenna is accommodated in the body.

In order to achieve yet still another aspect of the present invention, a method of using a portable terminal includes pushing a bar antenna section into a portable terminal such that the bar antenna section is accommodated in a body of the portable terminal, a first antenna section protruding from the body and the first antenna section and a second antenna section in the body forming a first antenna and pulling out the bar antenna section from the body in transmission such that the bar antenna section and the second antenna section form a second antenna.

The method may further include receiving an electromagnetic wave in a state in which the bar antenna section is pushed into the portable terminal.

The first and second antennas desirably have substantially same impedance.

DESCRIPTION OF THE PREFERRED EMBODIMENTS

Figure 1:
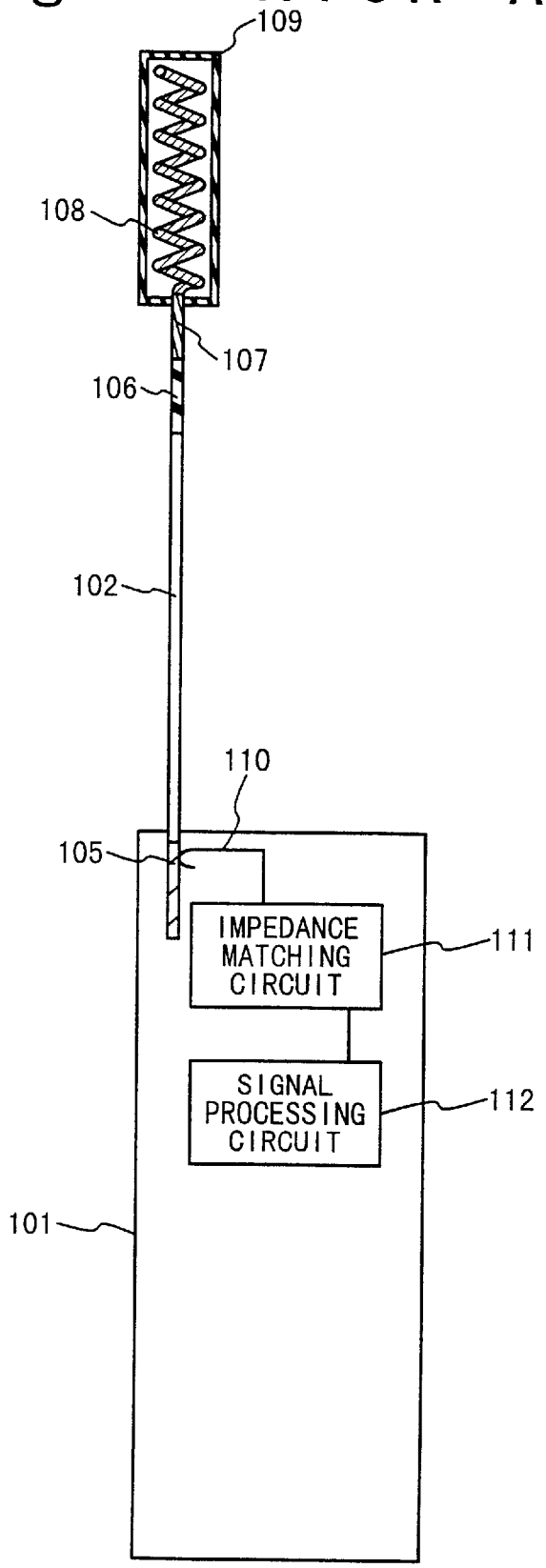
Fig. 1 PRIOR ART
FIG. 1 shows structure of a conventional portable transceiver, and shows structure in condition that a bar antenna 102 is extended.
Figure 2:
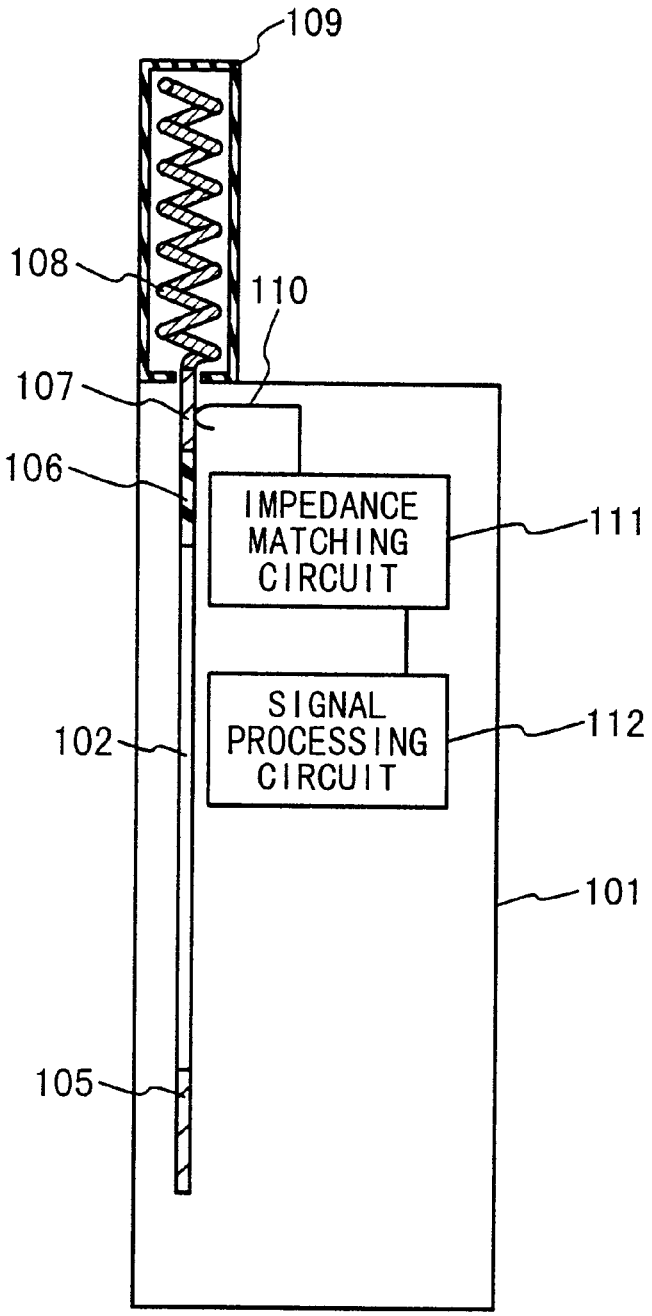
Fig. 2 PRIOR ART
FIG. 2 shows structure of the conventional portable transceiver, and shows structure in condition that the bar antenna 102 is accommodated.
Figure 3:
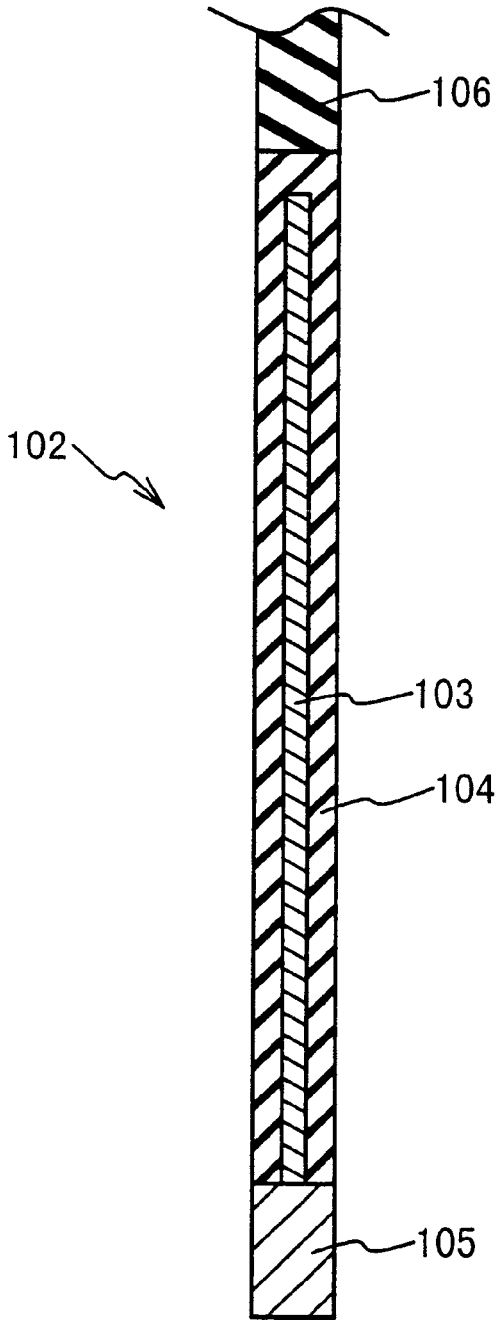
Fig. 3 PRIOR ART
FIG. 3 shows a section of the bar antenna 102 of the conventional portable transceiver.
Figure 4:
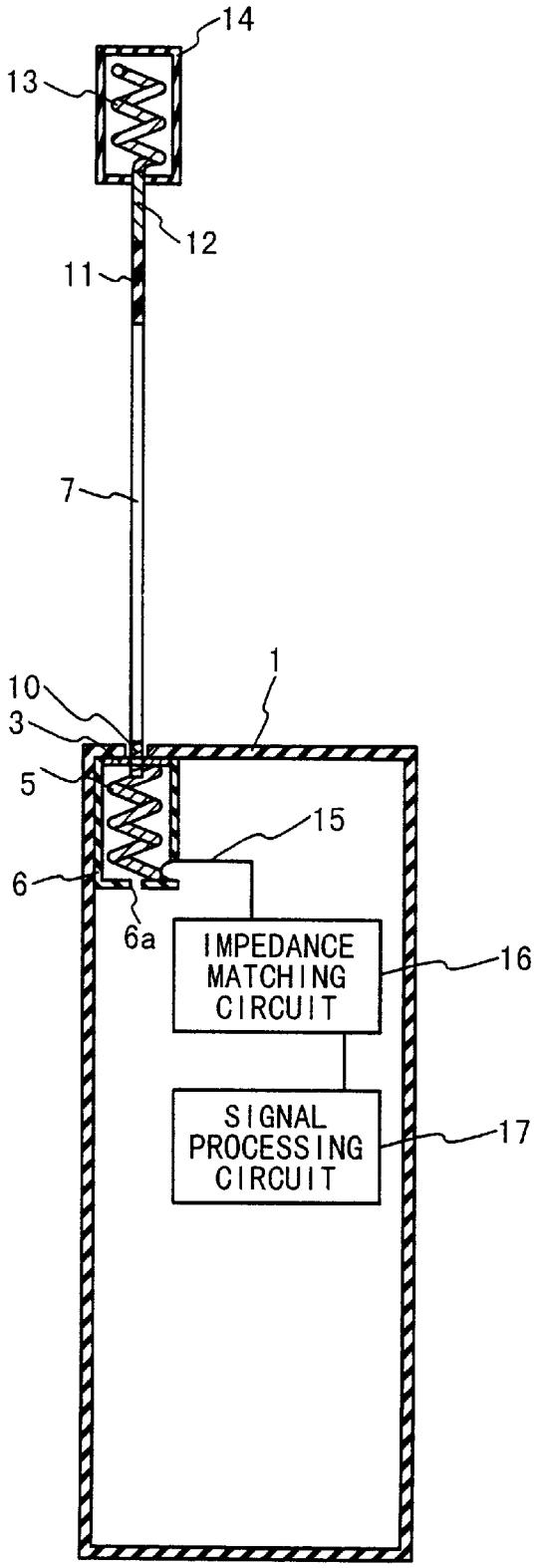
FIG. 4 shows structure in condition that a bar antenna 7 of a portable transceiver in a first embodiment is extended.
Figure 5:
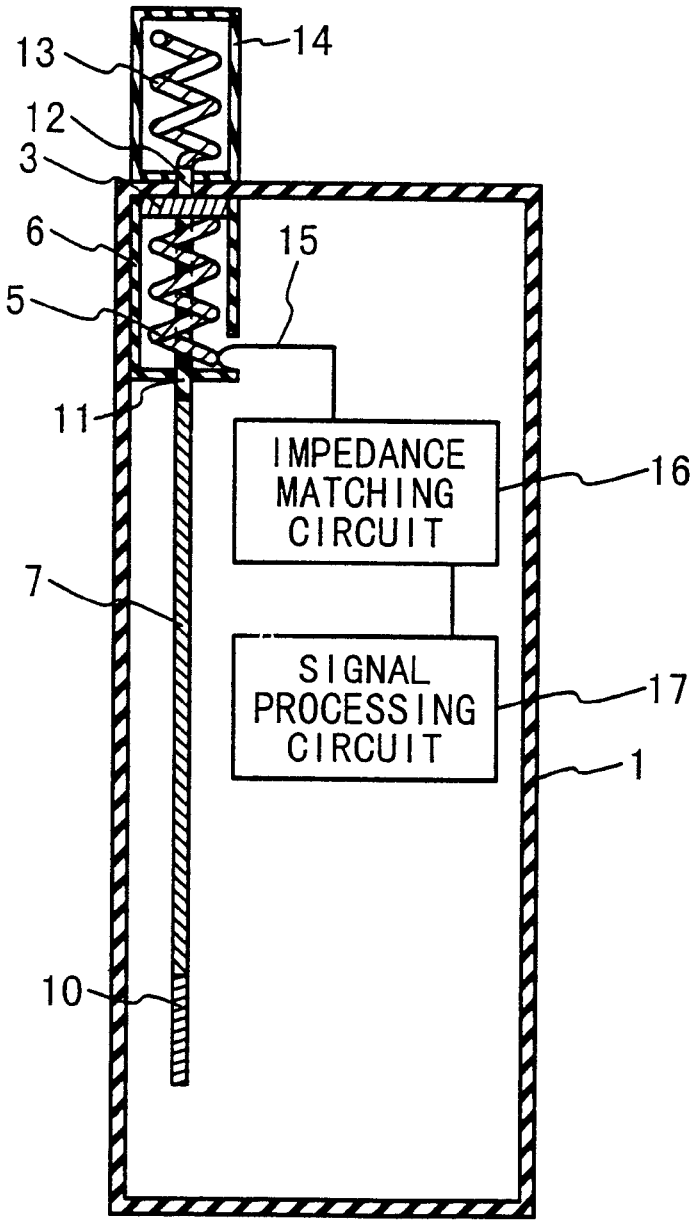
FIG. 5 shows structure in condition that the bar antenna 7 of the portable transceiver in the first embodiment is accommodated.
Figure 7:
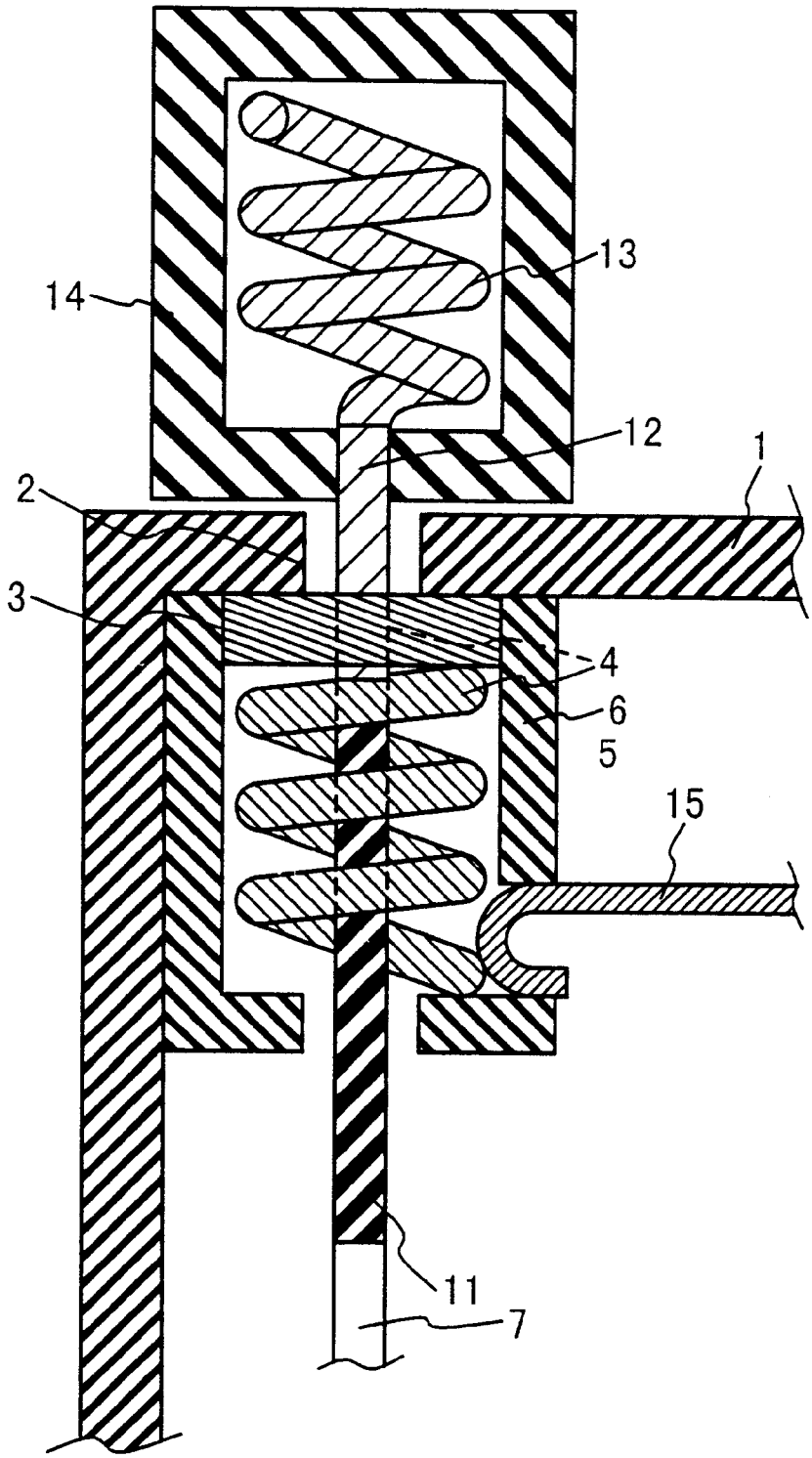
FIG. 7 shows structure in condition that the bar antenna 7 of the portable transceiver in the first embodiment is accommodated.
Figure 8:
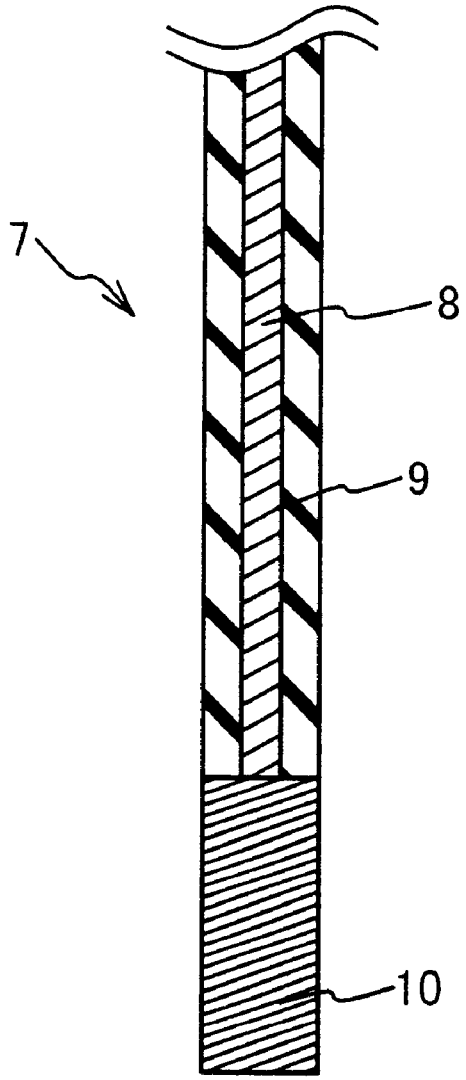
FIG. 8 shows structure in the vicinity of an end of the bar antenna 7 of the portable transceiver in the first embodiment.

A portable transceiver of the present invention will be described below with reference to the attached drawings. A portable transceiver of a first embodiment in the present invention includes a body as shown in FIGS. 4 and 5. A body 1 has a hole 2 as shown in FIGS. 7 and 8. A conductive ring terminal 3 is fixed to the body 1. The conductive ring terminal 3 has a hole 4. The hole 4 is indicated by dashed lines in FIGS. 7 and 8. The hole 4 is coupled to the hole 2. A fixed helical antenna 5 is coupled to the conductive ring terminal 3. The fixed helical antenna 5 is accommodated within the body 1.

A resin sleeve 6 is further coupled to the body 1. The conductive ring terminal 3 and the fixed helical antenna 5 are fixed to the resin sleeve 6. As for the body 1 and the resin sleeve 6, the structures of the sections of them are shown in FIGS. 4 to 8. The resin sleeve 6 has a hole 6*a* in the opposite side of the conductive ring 3.

A bar antenna 7 is inserted into the hole 2 mounted in the body 1. The bar antenna 7 further penetrates the hole 4 mounted in the conductive ring terminal 3. The bar antenna 7 can be accommodated in the body 1. The bar antenna 7 penetrates loops of the fixed helical antenna 5 when the bar antenna 7 is accommodated in the body 1. In addition, the bar antenna 7 penetrates the hole 6*a* when the bar antenna 7 is accommodated in the body 1.

Figure 6:
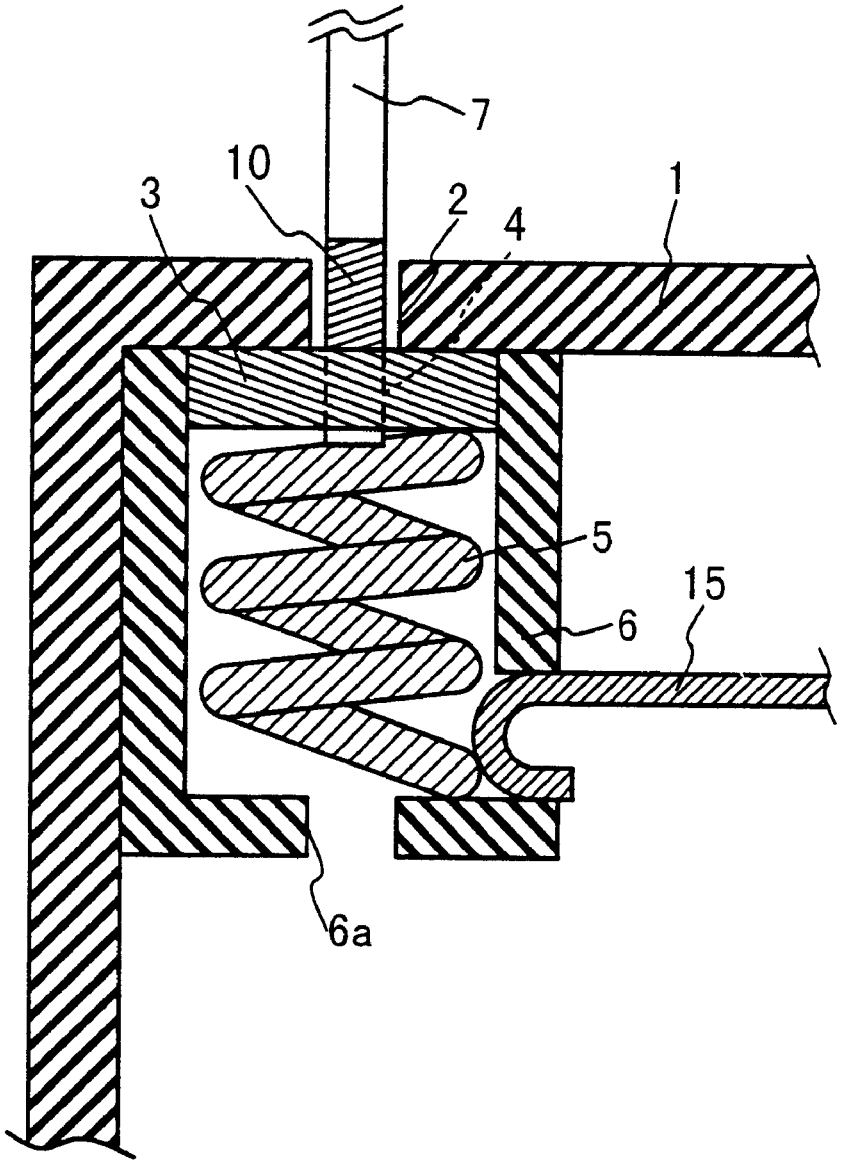
FIG. 6 shows structure in condition that the bar antenna 7 of the portable transceiver in the first embodiment is extended.

The bar antenna 7 includes a bar conductor 8 as shown in FIG. 6. The bar conductor 8 is a portion for transmitting and receiving electromagnetic waves. The bar conductor 8 is covered with a dielectric sleeve 9. The dielectric sleeve 9 slides on the inner surface of the hole 4 of the conductive ring terminal 3. The dielectric sleeve 9 also slides on the inner surface of the hole 6*a* of the dielectric sleeve 6. A conductive terminal 10 is mounted at an end of the bar antenna 7. The conductive terminal 10 is coupled to the conductor 8. The conductive terminal 10 contacts the inner surface of the hole 4 of the conductive ring 3 when the bar antenna 7 is pulled out from the body 1 to a maximum.

An insulating section 11 is coupled to the other end of the bar antenna 7. A conductive terminal 12 is coupled to the insulating section 11. The insulating section 11 insulates the conductor 8 and the conductive terminal 12 from each other. A tip helical antenna 13 is connected to the conductive terminal 12. The tip helical antenna 13 is covered with a cover 14. As for the cover 14, the structure of the section of the cover 14 is shown in FIGS. 4 to 8.

Moreover, a wiring 15 is connected to the fixed helical antenna 5. The wiring 15 is connected to an impedance matching circuit 16. The impedance matching circuit 16 is connected to the signal processing circuit 17. The impedance matching circuit 16 matches an impedance of a signal processing circuit 17 with an impedance of an antenna portion composed of the fixed helical antenna 5, the bar antenna 7 and the tip helical antenna 13. The signal processing circuit 17 carries out a signal process for transmission and reception.

An impedance measured from the wiring 15 when the conductive terminal 10 contacts with the conductive ring terminal 3 after the extension of the bar antenna 7 is substantially equal to an impedance measured from the wiring 15 when the conductive terminal 12 contacts the conductive ring terminal 3 after the accommodation of the bar antenna 7 in the body 1. This is attained by making an impedance of the bar antenna 7 substantially equal to that of the tip helical antenna 13.

Also, a sum of an effective height of the fixed helical antenna 5 and an effective height of the tip helical antenna 13 is larger than one fourth of a wave length of electromagnetic waves which is transmitted and received by them.

The portable transceiver of the first embodiment in the present invention is operated as follows.

The bar antenna 7 may be extended (pulled out), when the transceiver transmits a electromagnetic wave. When the bar antenna 7 is extended, the conductive terminal 10 connected to the conductor 8 is electrically connected through the conductive ring terminal 3 to the fixed helical antenna 5, as shown in FIGS. 4 and 7. The fixed helical antenna 5 is electrically connected through the wiring 15 to the impedance matching circuit 16.

At this time, the tip helical antenna 13 is electrically insulated from the conductive ring terminal 3. When the bar antenna 7 is extended, the conductive ring terminal 3 and the conductor 8 function as an antenna. The effective height of the antenna is larger than one fourth of a wave length of electromagnetic waves which is transmitted and received by the antenna.

The bar antenna 7 may be accommodated, when the transceiver waits to receive a electromagnetic wave. When the bar antenna 7 is accommodated in the body 1, the tip helical antenna 13 is electrically connected through the conductive terminal 12 and the conductive ring terminal 3 to the fixed helical antenna 5, as shown in FIGS. 5 and 8. The fixed helical antenna 5 is electrically connected through the wiring 15 to the impedance matching circuit 16.

At this time, the bar antenna 7 is electrically insulated from the fixed helical antenna 5. When the bar antenna 7 is extended, the conductive ring terminal 3 and the tip helical antenna 13 function as another antenna. The effective height of the antenna is larger than one fourth of a wave length of electromagnetic waves which is transmitted and received by the antenna.

In the portable transceiver of the first embodiment, when the bar antenna 7 is accommodated in the body 1, the tip helical antenna 13 and the fixed helical antenna 5 within the body 1 operates as an antenna. Even if a tip helical antenna 13 has a short axis, the effective height of the antenna portion can be more than one fourth of a wave length of electromagnetic waves used for the communication. In the portable transceiver of the first embodiment, the tip helical antenna 13 can be miniaturized.

In succession, a portable transceiver of a second embodiment in the present invention is described. The structure of the portable transceiver of the second embodiment is similar to that of the portable transceiver of the first embodiment. The structure of the second embodiment is different in a connection mechanism between a fixed helical antenna 5 and a conductor 8 and a connection mechanism between the fixed helical antenna 5 and a tip helical antenna 13, from the portable transceiver of the first embodiment.

Figure 9:
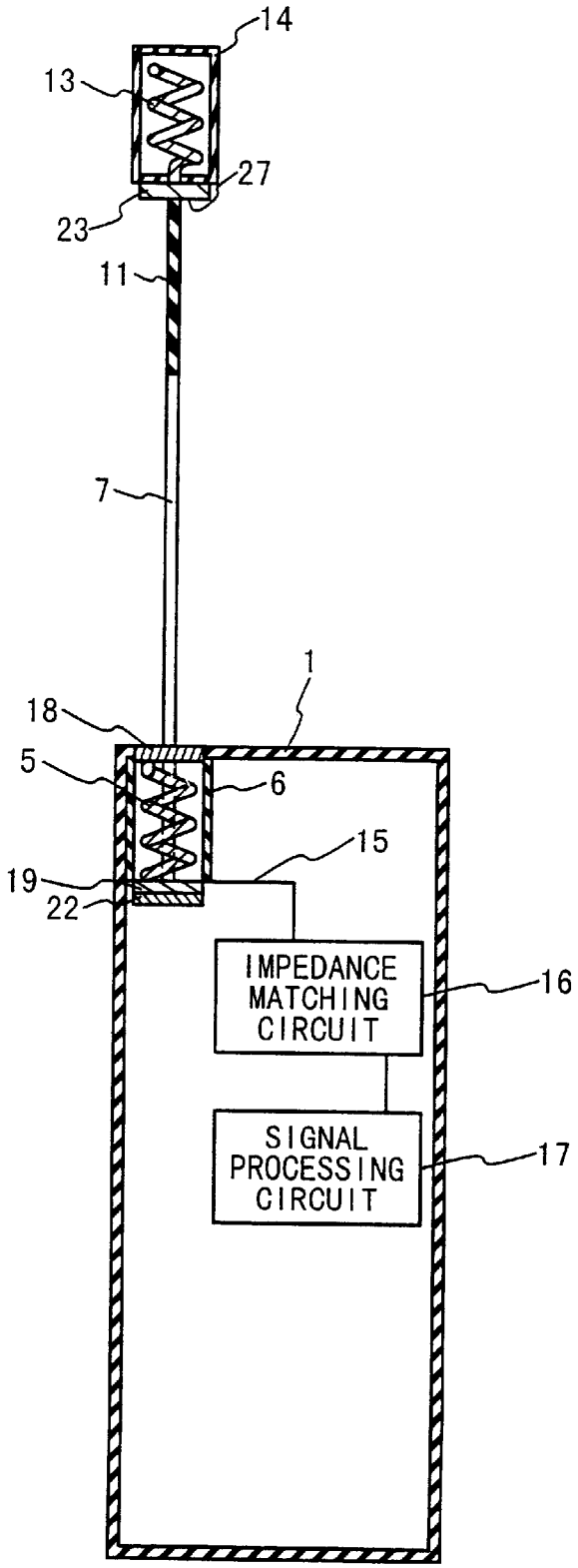
FIG. 9 shows structure in condition that a bar antenna 7 of a portable transceiver in a second embodiment is extended.
Figure 10:
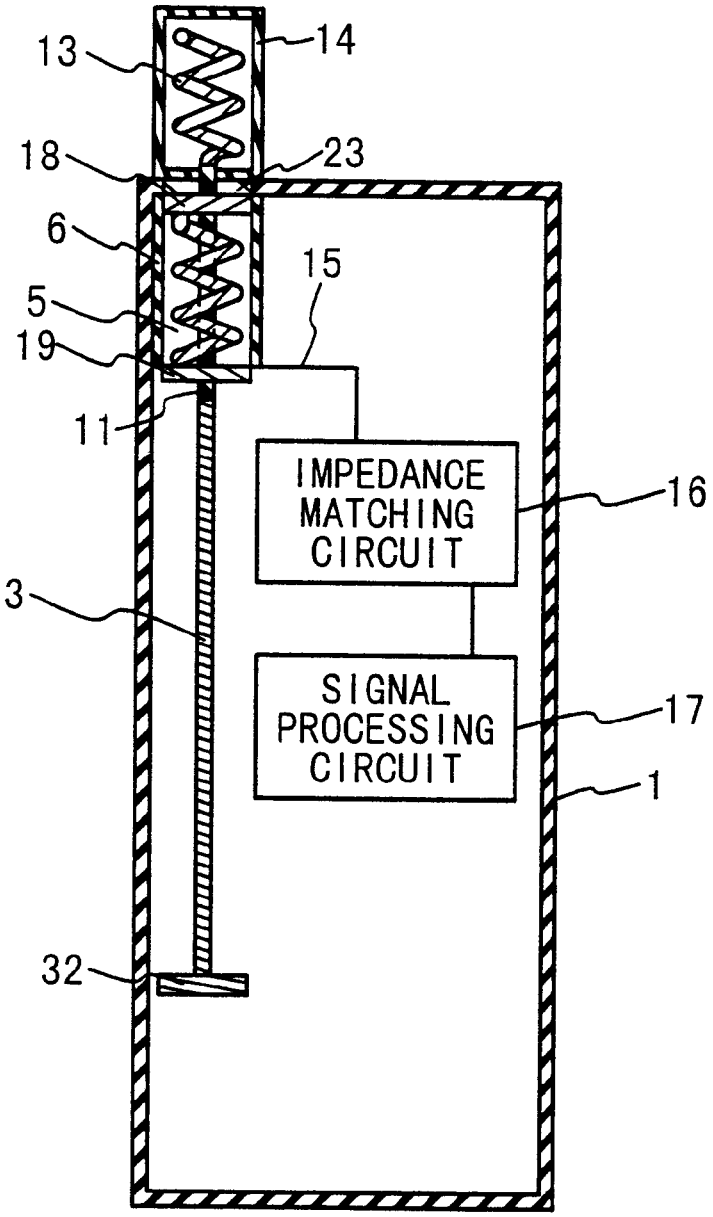
FIG. 10 shows structure in condition that the bar antenna 7 of the portable transceiver in the second embodiment is accommodated.

The portable transceiver of the second embodiment has a body. As shown in FIGS. 9 and 10A, a conductive ring terminal 18 is connected to the body 1. The conductive ring terminal 18 is exposed on surface of the body 1. An end of the fixed helical antenna 5 is coupled to the conductive ring terminal 18. The other end of the fixed helical antenna 5 is coupled to a conductive ring terminal 19. A resin sleeve 6 is further coupled to the body 1. The fixed helical antenna 5 is fixed to the resin sleeve 6.

Figure 11:
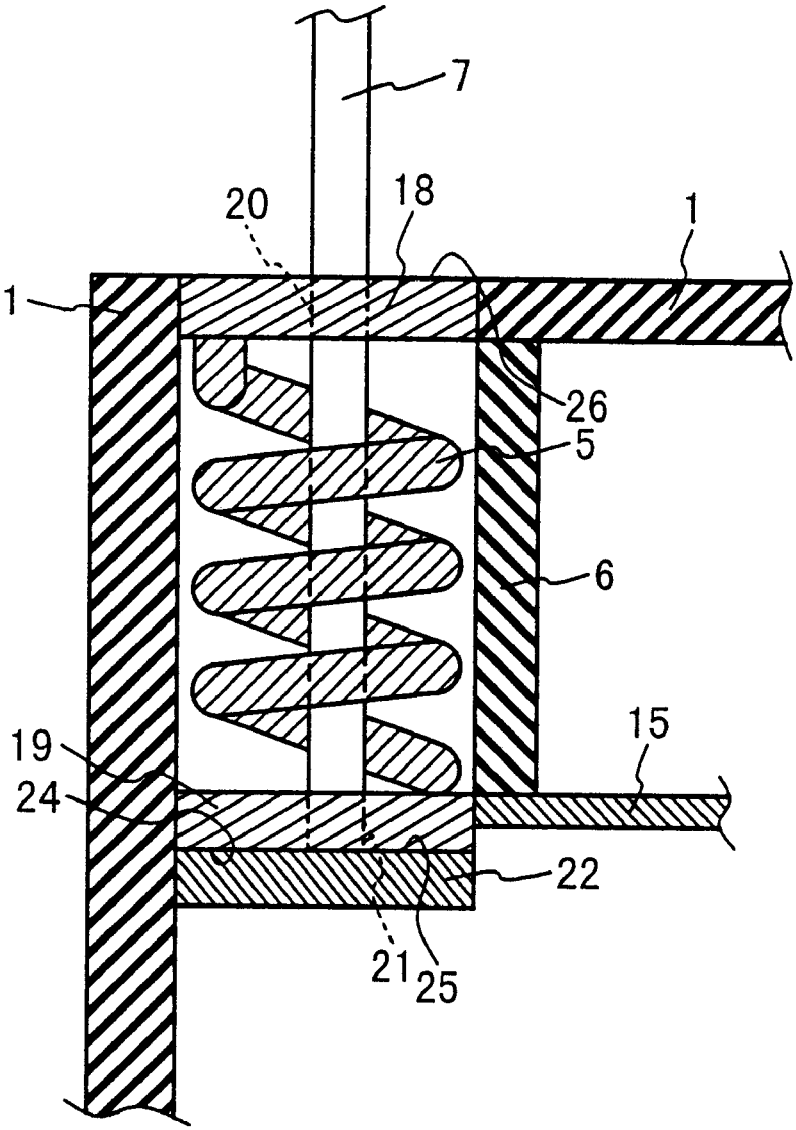
FIG. 11 shows structure in condition that the bar antenna 7 of the portable transceiver in the second embodiment is extended.
Figure 12:
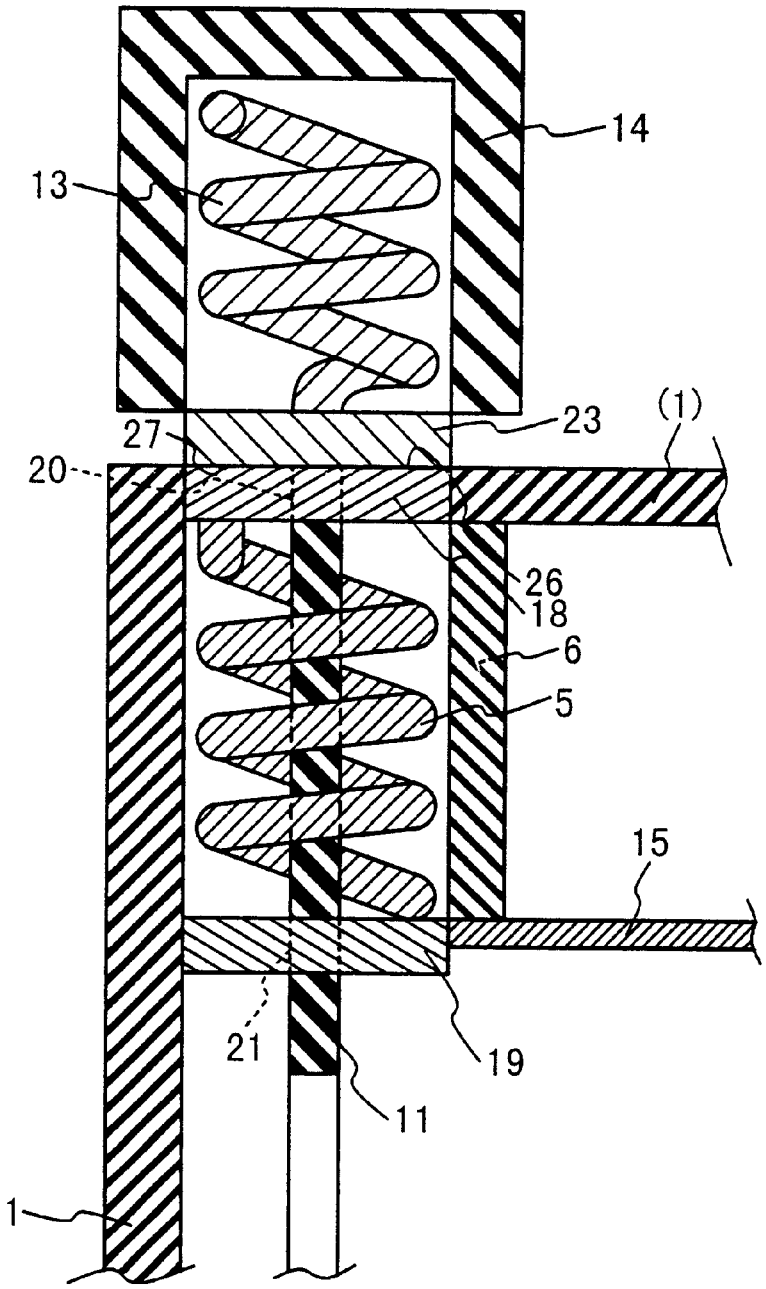
FIG. 12 shows structure in condition that the bar antenna 7 of the portable transceiver in the second embodiment is accommodated

As shown in FIGS. 11 and 12, a hole 20 is formed in the conductive ring terminal 18. A hole 21 is formed in the conductive ring terminal 19. A bar antenna 7 is inserted through the hole 20, the fixed helical antenna 5 and the hole 21.

Figure 13:
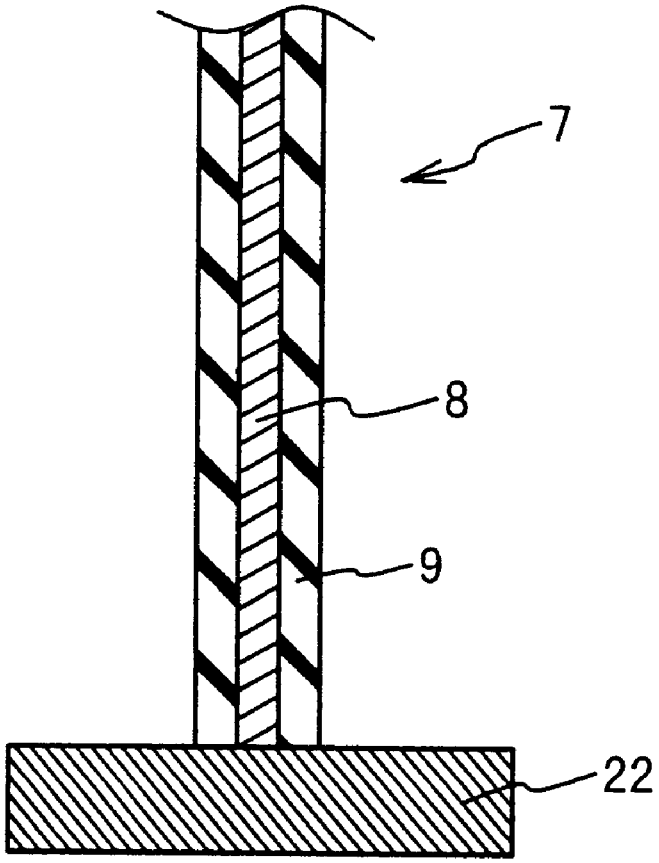
FIG. 13 shows structure of the bar antenna 7 of the portable transceiver in the second embodiment.

A conductive terminal 22 is coupled to an end of the bar antenna 7. The end coupled to the conductive terminal 22 is accommodated in the body 1. As shown in FIG. 13, the conductive terminal 22 is coupled to a conductor 8 contained in the bar antenna 7. The conductor 8 is covered with a dielectric sleeve 9. The conductive terminal 22 is cylinder-shaped. The conductive terminal 22 has a diameter larger than that of the hole 21. Thus, the bar antenna 7 is not detached from the body 1.

An insulating section 11 is coupled to an end outside the body 1, among the ends of the bar antenna 7. A conductive terminal 23 is coupled to the insulating section 11. The conductive terminal 23 is cylinder-shaped. The conductive terminal 23 has a diameter larger than that of the hole 20. The tip helical antenna 13 is connected to the conductive terminal 23. The tip helical antenna 13 is covered by a cover 14.

The conductive terminal 19 is connected to a wiring 15. The wiring 15 is connected to an impedance matching circuit 16. The impedance matching circuit 16 is connected to a signal processing circuit 17. The impedance matching circuit 16 and the signal processing circuit 17 respectively function similarly to those contained in the portable transceiver of the first embodiment.

An impedance measured from the wiring 15 when the conductive ring terminal 19 contacts the conductive terminal 22 after the extension of the bar antenna 7 is substantially equal to an impedance measured from the wiring 15 when the conductive ring terminal 18 contacts the conductive terminal 23 after the accommodation of the bar antenna 7 in the body 1. This is attained by making an impedance of the bar antenna 7 substantially equal to that of the tip helical antenna 13.

Also, a sum of an effective height of the fixed helical antenna 5 and an effective height of the tip helical antenna 13 is substantial one fourth of a wave length of electromagnetic waves which is transmitted and received by them.

The portable transceiver of the second embodiment in the present invention is operated as follows. When the bar antenna 7 is extended, a surface 24 of the conductive ring terminal 19 contacts a surface 25 of the conductive terminal 22. The conductor 8 contained in the bar antenna 7 is electrically connected through the conductive terminal 22, the conductive ring terminal 19 and the. wiring 15 to the impedance matching circuit 16. Also, the fixed helical antenna 5 is electrically connected through the conductive ring terminal 19 and the wiring 15 to the impedance matching circuit 16. The fixed helical antenna 5 and the conductor 8 form an antenna.

When the bar antenna 7 is accommodated in the body 1, a surface 26 of the conductive ring terminal 18 contacts a surface 27 of the conductive terminal 23. The tip helical antenna 13 is electrically connected through the conductive terminal 23 and the conductive ring terminal 18 to the fixed helical antenna 5. The fixed helical antenna 5 is electrically connected through the conductive ring terminal 19 and the wiring 15 to the impedance matching circuit 16. The fixed helical antenna 5 and the conductor 8 form another antenna.

In the portable transceiver of the second embodiment, the tip helical antenna 13 can be miniaturized similarly to the portable transceiver of the first embodiment. Moreover, the portable transceiver of the second embodiment has stable electric connection between the bar antenna 7 and the impedance matching circuit 16.

The reason is as follows. The conductive ring terminal 19 and the conductive terminal 22 are connected through the surfaces 24, 25 to each other. The surfaces 24, 25 are not mutually slid. Therefore. The contact between them is stable, which enables the electrical connection between the conductive ring terminal 19 and the conductive terminal 22 to be stable.

Also, the portable transceiver of the second embodiment has stable electric connection between the tip helical antenna 13 and the impedance matching circuit 16. This is because the surfaces 26, 27, through which the conductive ring terminal 18 and the conductive terminal 23 are connected, are not mutually slid.

In succession, a portable transceiver of a third embodiment in the present invention is described. The structure of the portable transceiver of the third embodiment is similar to those of the portable transceiver of the first embodiment and the portable transceiver of the second embodiment. The structure of the third embodiment is different in connection mechanism between a fixed helical antenna 5 and a conductor 8 and connection mechanism between the fixed helical antenna 5 and a tip helical antenna 13, from the portable transceivers of the first and second embodiments.

Figure 14:
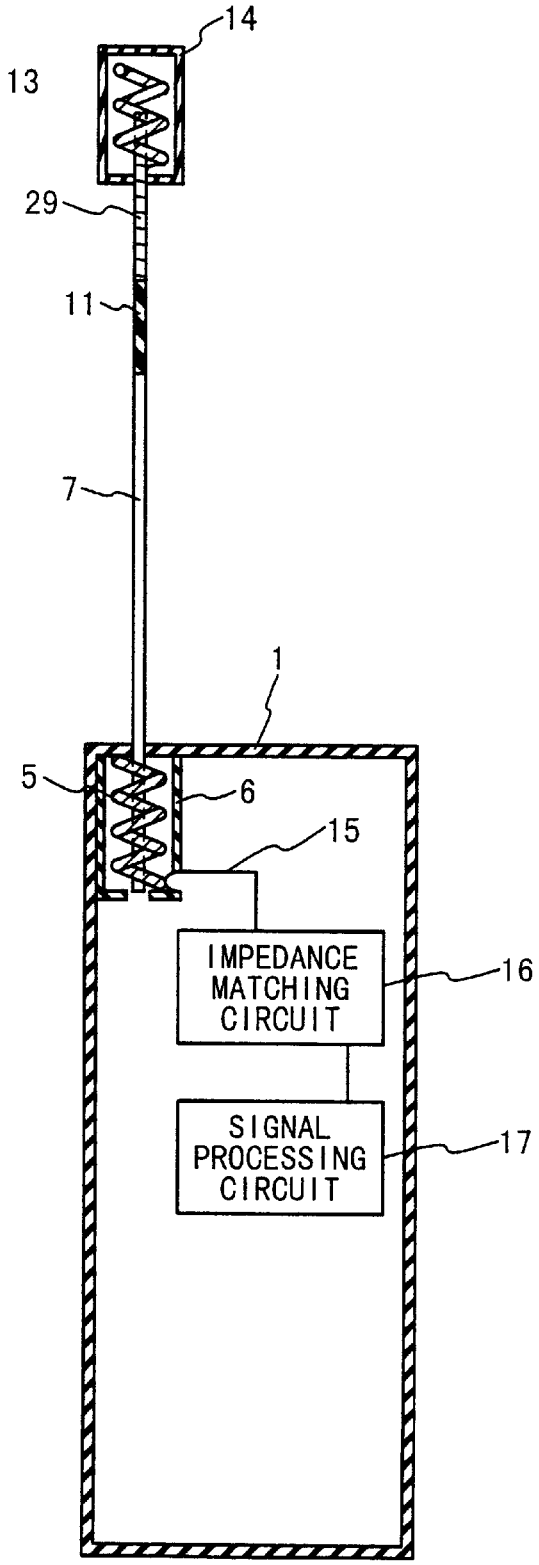
FIG. 14 shows structure in condition that a bar antenna 7 of a portable transceiver in a third embodiment is extended.
Figure 15:
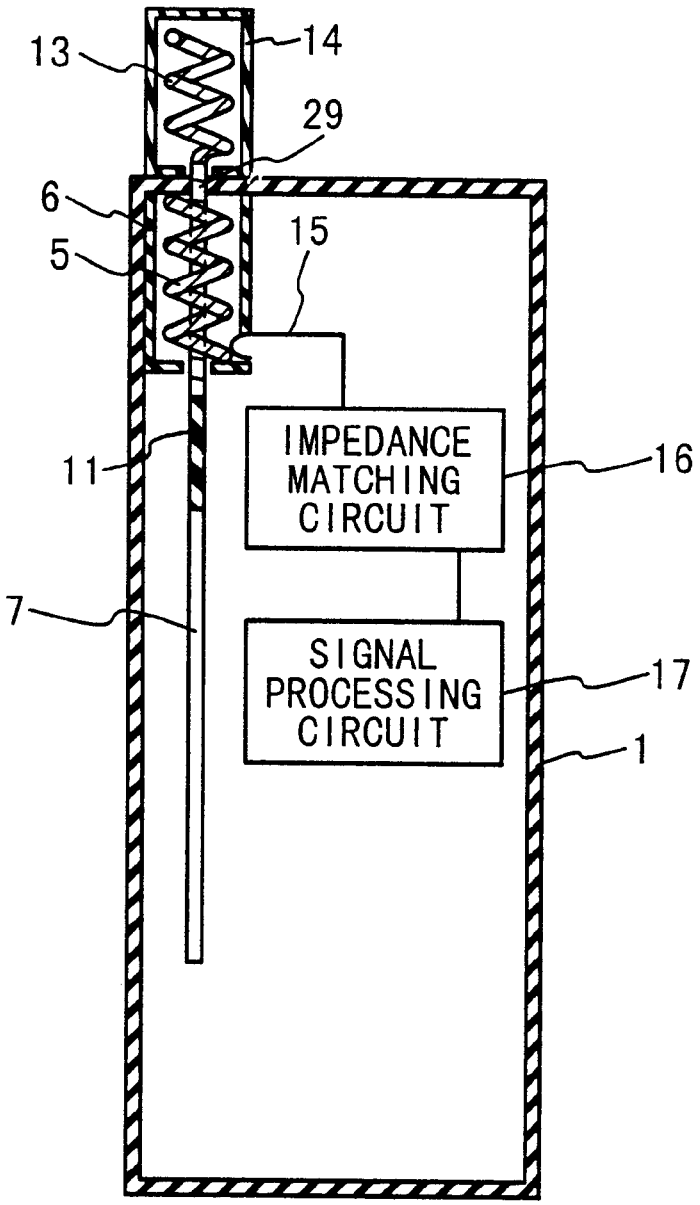
FIG. 15 shows structure in condition that the bar antenna 7 of the portable transceiver in the third embodiment is accommodated.

The portable transceiver of the third embodiment has a body. A resin sleeve 6 is coupled to its body 1 as shown in FIGS. 14 and 15. The fixed helical antenna 5 is accommodated in the resin sleeve 6.

Figure 16:
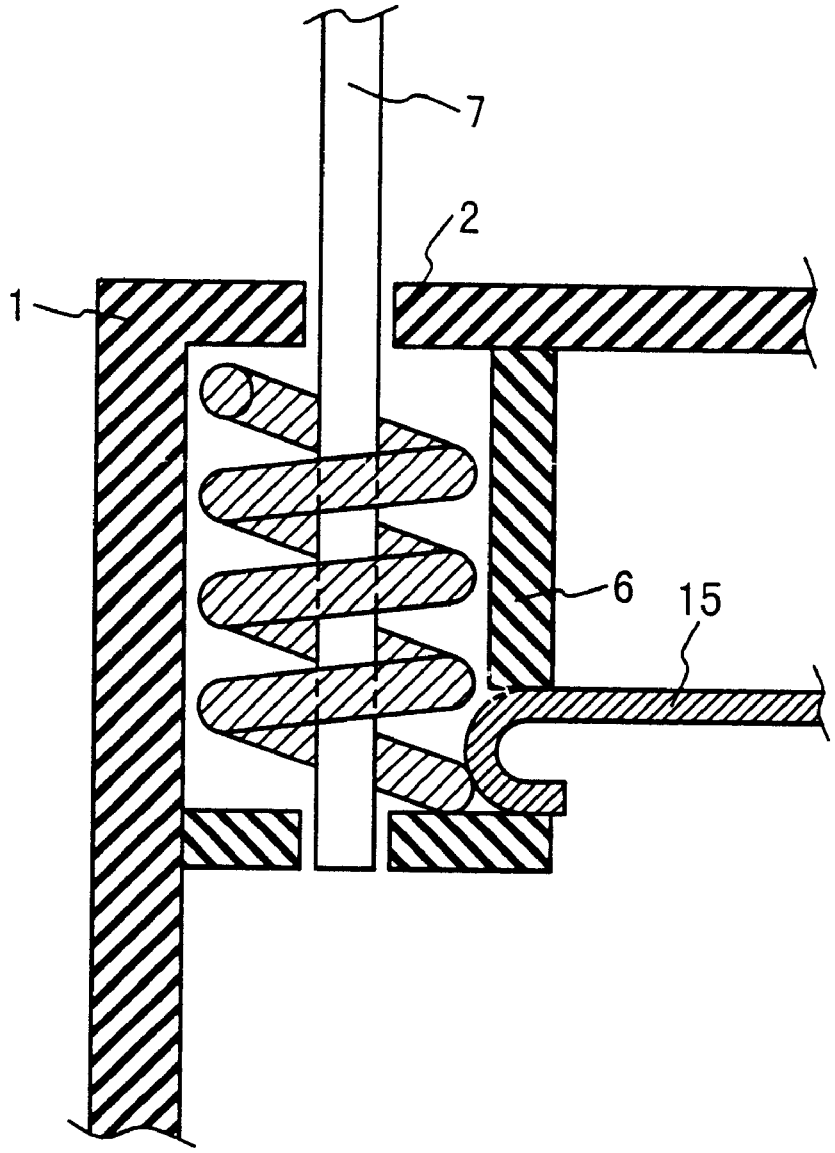
FIG. 16 shows structure in condition that the bar antenna 7 of the portable transceiver in the third embodiment is extended.
Figure 17:
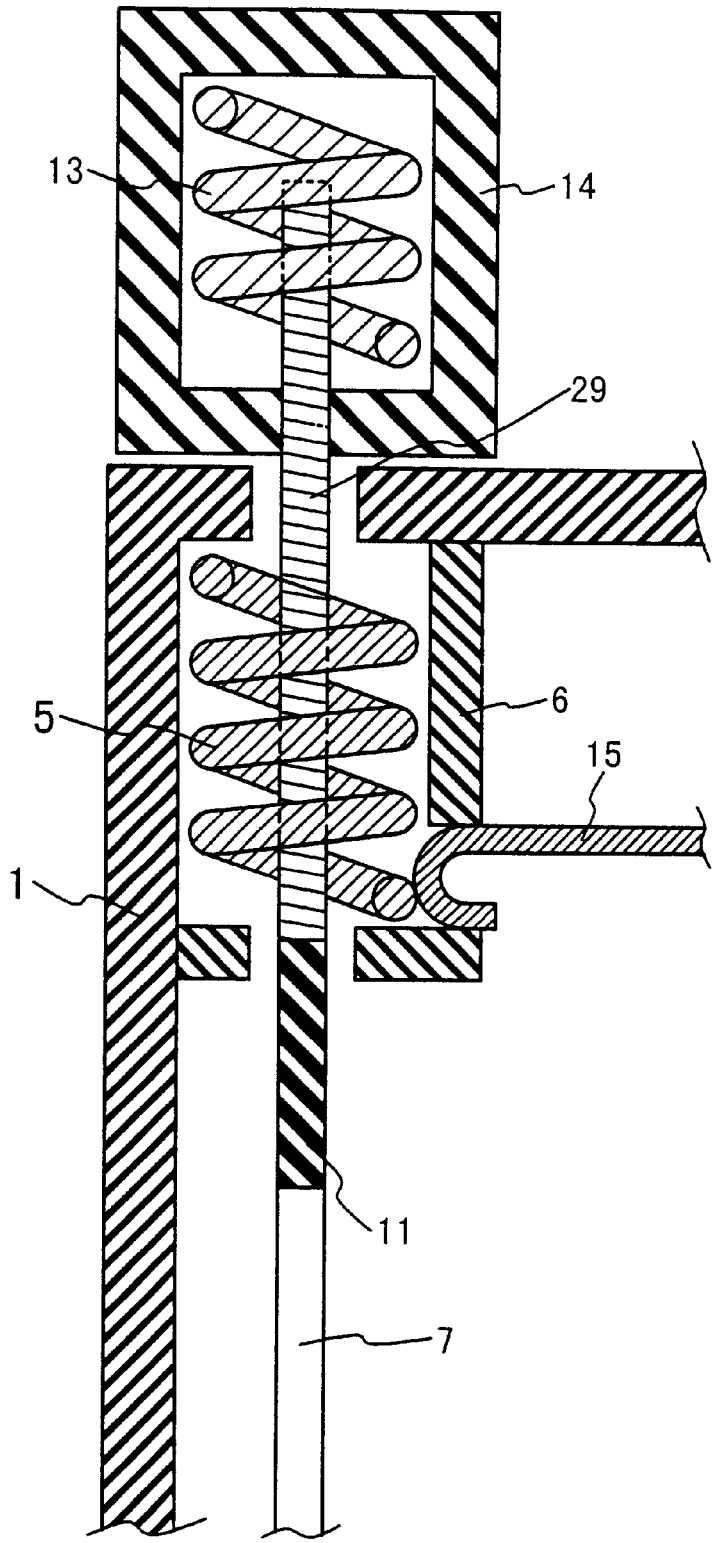
FIG. 17 shows structure in condition that the bar antenna 7 of the portable transceiver in the second embodiment is accommodated.
Figure 18:
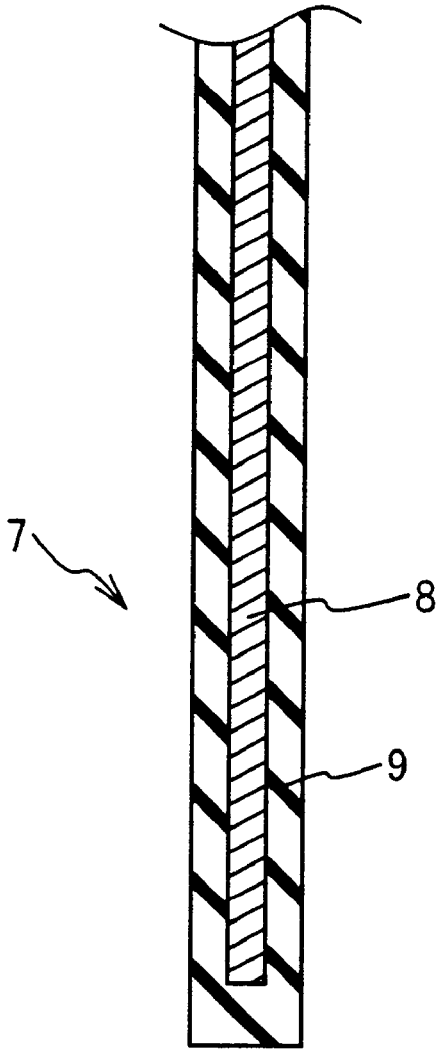
FIG. 18 shows structure of the bar antenna 7 of the portable transceiver in the third embodiment.

A hole 2 is formed in the body 1, as shown in FIGS. 16 and 17. An end of the bar antenna 7 is inserted through loops of the fixed helical antenna 5 and the hole 2. The bar antenna 7 contains a conductor 8 as shown in FIG. 18. The conductor 8 is covered with a dielectric sleeve 9. The fixed helical antenna 5 and the conductor 8 are close to each other in the condition that the bar antenna 7 is extended from the body 1. The fixed helical antenna 5 and the conductor 8 form a considerable capacitance between them in the condition that the bar antenna 7 is extended from the body 1.

An insulating section 11 is coupled to the other end of the bar antenna 7. An end of a conductive terminal 29 is connected to the insulating section 11. The other end of the conductive terminal 29 is inserted into the tip helical antenna 13. The conductive terminal 29 and the tip helical antenna 13 are close to each other such that a considerable capacitance is generated between them. The tip helical antenna 13 is covered with a cover 14. In the conductive terminal 29, a length of a portion located outside the cover 14 and the tip helical antenna 13 is substantially equal to an axis length of the fixed helical antenna 5.

On the other hand, the fixed helical antenna 5 is connected to a wiring 15. The wiring 15 is connected to an impedance matching circuit 16. The impedance matching circuit 16 is connected to a signal processing circuit 17. The impedance matching circuit 16 and the signal processing circuit 17 function similarly to those contained in the portable transceiver of the first embodiment.

An impedance measured from the wiring 15 when the end of the bar antenna 7 is inserted into the fixed helical antenna 5 after the extension of the bar antenna 7 is substantially equal to an impedance measured from the wiring 15 when the conductive terminal 29 is inserted into the fixed helical antenna 5 after the accommodation of the bar antenna 7 in the body 1. This is attained by adjusting a length of the conductor 8 contained in the bar antenna 7 and the number of turns of the tip helical antenna 13.

Also, a sum of an effective height of the fixed helical antenna 5 and an effective height of the tip helical antenna 13 is substantial one fourth of a wave length of electromagnetic waves which is transmitted and received by them.

The portable transceiver of the third embodiment is operated as follows. When the bar antenna 7 is accommodated in the body 1, the conductive terminal 29 is inserted into the fixed helical antenna 5, as shown in FIGS. 14 and 16. The fixed helical antenna 5 and the conductive terminal 29 become close to each other to accordingly generate a capacitance. The fixed helical antenna 5 and the conductive terminal 29 are electrically connected to each other in a frequency band of electromagnetic waves which the fixed helical antenna 5 and the tip helical antenna 13 transmit and receive. On the other hand, the tip helical antenna 13 and the conductive terminal 29 generate a capacitance between them, and are electrically connected to each other similarly to the fixed helical antenna 5 and the tip helical antenna 13. This result in that between the fixed helical antenna 5 and the tip helical antenna 13 is electrically connected. The fixed helical antenna 5 is connected through the wiring 15 to the impedance matching circuit 16. At this time, the conductor 8 is insulated through the insulating section 11 from the fixed helical antenna 5. When the bar antenna 7 is accommodated in the body 1, the fixed helical antenna 5 and the tip helical antenna 13 function as an antenna.

When the bar antenna 7 is extended from the body 1, a part of the bar antenna 7 is inserted into the whole inside of the fixed helical antenna 5, as shown in FIGS. 15 and 17.

Capacitance is generated between the conductor 8 contained in the bar antenna 7 and the fixed helical antenna 5. The fixed helical antenna 5 and the conductor 8 are electrically connected to each other in a frequency band of electromagnetic waves which they transmit and receive. At this time, the tip helical antenna 13 is electrically insulated through the insulating section 11 from the conductor 8. When the bar antenna 7 is extended, the conductive ring terminal 3 and the tip helical antenna 13 function as an antenna.

In the portable transceiver of the third embodiment, the tip helical antenna 13 can be miniaturized similarly to the portable transceivers of the first and second embodiments. Moreover, in the portable transceiver of the third embodiment, the electrical connection between the fixed helical antenna 5 and the conductor 8 is more stable than those of the portable transceivers of the first and second embodiments. This is because in the portable transceivers of the first and second embodiments, the conductors come in direct contact with each other, and are connected to each other. The direct contact between the conductors may disable the stable connection to be established. In the portable transceiver of the third embodiment, the fixed helical antenna 5 and the conductor 8 are electrically connected to each other without directly contacting. Thus, the electrical connection is stable.

Furthermore, in the portable transceiver of the third embodiment, the electrical connection between the fixed helical antenna 5 and the tip helical antenna 13 is stable due to the reason similar to the above-mentioned reason.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A transceiver comprising:

a transceiver housing having an interior and an exterior, said transceiver housing having transceiver electronic components disposed in said interior thereof;

a first helical antenna disposed in said interior of said transceiver housing; and a bar antenna extractably insertable into said interior of said transceiver housing from said exterior of said transceiver housing through an opening therein, said bar antenna being insulatively connected at its first end to a second helical antenna, said second helical antenna being shorter than said first helical antenna;

wherein said first helical antenna selectively makes electrical connection with one of a second end of said bar antenna and said second helical antenna.

2. The transceiver of claim 1 wherein said first helical antenna makes electrical connection with said second end of said bar antenna when said bar antenna has been extracted from said interior of said housing.

3. The transceiver of claim 1 wherein said first helical antenna makes electrical connection with said second helical antenna when said bar antenna has been inserted into said interior of said housing.

4. The transceiver of claim 1 further comprising an impedance matching circuit electrically connected to said first helical antenna.

5. The transceiver of claim 2 wherein, when electrically connected, said first helical antenna and said bar antenna have an effective length that is equal to or greater than a wavelength of an electromagnetic wave received by said transceiver.

6. The transceiver of claim 3 wherein, when electrically connected, said first helical antenna and said second helical antenna have an effective length that is equal to or greater than a wavelength of an electromagnetic wave received by said transceiver.

7. The transceiver of claim 1 wherein said first helical antenna electrically connects to said second helical antenna to form an antenna that has an impedance substantially equal to an impedance of an antenna formed when said first helical antenna makes electrical connection with said second end of said bar antenna.

8. The transceiver of claim 1 further comprising an electrically conductive disk having a surface facing said interior of said housing and an opening substantially coinciding with said opening in said housing, wherein said first helical antenna makes electrical contact with said surface of said electrically conductive disk, and said bar antenna and said second helical antenna selectively make electrical contact with said electrically conductive disk when said bar antenna is extracted and inserted respectively.

9. The transceiver of claim 1 further comprising an electrically conductive disk having a first surface facing said interior of said housing and making electrical contact with said first helical antenna, a second surface opposing said first surface, and an opening substantially coinciding with said opening in said housing; wherein said second surface makes electrical contact with an electrically conductive disk electrically connected to said second helical antenna when said bar antenna is inserted into said housing.

10. The transceiver of claim 9 further comprising a second electrically conductive disk having a first surface in electrical contact with said first helical antenna and a second surface for making electrical contact with an electrically conductive disk that is electrically connected to said second end of said bar antenna when said bar antenna is extracted from said interior of said housing.

11. A transceiver comprising:

a transceiver housing having an interior and an exterior, said transceiver housing having transceiver electronic components disposed in said interior thereof;

a first helical antenna disposed in said interior of said transceiver housing;

a bar antenna extractably insertable into said interior of said transceiver housing from said exterior of said transceiver housing through an opening therein;

an electrically conductive bar insulatively connected to a first end of said bar antenna; and a second helical antenna capacitively connected to said electrically conductive bar, said second helical antenna being shorter than said first helical antenna;

wherein said first helical antenna selectively makes capacitive connection with one of a said bar antenna and said electrically conductive bar.

12. The transceiver of claim 11 wherein said conductive bar is partially disposed inside an interior of said second helical antenna.

13. The transceiver of claim 12 wherein said first helical antenna is capacitively connected with said second helical antenna when said conductive bar is partially disposed inside an interior of said first helical antenna.

14. The transceiver of claim 11 wherein said first helical antenna makes capacitive connection with said bar antenna when said bar antenna is partially disposed in an interior of said first helical antenna.

15. The transceiver of claim 11 further comprising an impedance matching circuit electrically connected to said first helical antenna.

16. A transceiver comprising:

a transceiver housing having an interior and an exterior, said transceiver housing having transceiver electronic components disposed in said interior thereof;

a bar antenna extractably insertable in said transceiver housing through an opening therein, said bar antenna including a first conductive bar; and a second conductive bar insulatively connected to a first end of said bar antenna;

wherein said second conductive bar capacitively connects a first helical antenna disposed in said transceiver housing to a second helical antenna.

17. The transceiver of claim 16 wherein said second conductive bar is partially disposed in an interior of said first helical antenna and partially disposed in an interior of said second helical antenna to capacitively connect said first helical antenna and said second helical antenna.

18. The transceiver of claim 16 wherein said first helical antenna capacitively connects with said bar antenna.

19. The transceiver of claim 18 wherein said first helical antenna capacitively connects with said bar antenna when said bar antenna is partially inserted in an interior of said first helical antenna.

20. The transceiver of claim 16 wherein said first helical antenna capacitively connects to said second helical antenna when said bar antenna is inserted in said housing.

* * * * *